United States Patent [19]

Taniguchi et al.

[11] Patent Number: 4,830,930

[45] Date of Patent: May 16, 1989

[54] SURFACE-REFINED SINTERED ALLOY BODY AND METHOD FOR MAKING THE SAME

[75] Inventors: Yasuro Taniguchi; Ko Sasaki; Mitsuo Ueki; Keiichi Kobori, all of Kawasaki, Japan

[73] Assignee: Toshiba Tungaloy Co., Ltd., Kawasaki, Japan

[21] Appl. No.: 178,933

[22] Filed: Apr. 7, 1988

Related U.S. Application Data

[63] Continuation-in-part of Ser. No. 116,219, Nov. 3, 1987, abandoned.

[30] Foreign Application Priority Data

Jan. 5, 1987 [JP] Japan ..... 61-314817

[51] Int. Cl.[4] ..... B22F 3/00

[52] U.S. Cl. ..... 428/547; 428/552; 428/610; 75/230; 75/232; 75/244; 419/10; 419/13; 419/19

[58] Field of Search ..... 428/547, 610, 552; 75/230, 232, 244; 419/10, 13, 19

[56] References Cited

U.S. PATENT DOCUMENTS 4,265,662 5/1981 Miyake et al. ..... 75/238
4,277,283 7/1981 Tobioka et al. ..... 75/238
4,610,931 9/1986 Nemeth et al. ..... 428/547
4,619,866 10/1986 Smith et al. ..... 428/698
4,639,352 1/1987 Kodama et al. ..... 419/13
4,686,080 8/1987 Hara et al. ..... 428/698

*Primary Examiner*—Stephen J. Lechert, Jr.
*Attorney, Agent, or Firm*—Foley & Lardner, Schwartz, Jeffery, Schwaab, Mack, Blumenthal & Evans

[57] ABSTRACT

There are disclosed a surface refined sintered alloy body which comprises a hard phase containing at least one selected from the group consisting of carbides, carbonitrides, carbooxides, carbonitrooxides of the metals of the groups 4a, 5a and 6a of the periodic table and a binding phase containing at least one selected from iron group metals, characterized in that the concentration of the binding phase in the surface layer (of from 10 μm to 500 μm from the surface of the sintered alloy) is highest at the outermost surface thereof and approaches the concentration of the inner portion, the concentration of the binding phase decreasing from the outermost surface to a point at least 5 μm from the surface; and a method for making the same by applying decarburization treatment at the surface of the sintered alloy at temperatures within the solid-liquid co-existing region of the binding phase after sintering or in the process of sintering.

12 Claims, 7 Drawing Sheets

SURFACE-REFINED SINTERED ALLOY BODY AND METHOD FOR MAKING THE SAME

This application is a continuation-in-part of our copending application Ser. No. 116,219, filed Nov. 3, 1987, abandoned.

BACKGROUND OF THE INVENTION

This invention relates to a sintered alloy body subjected to thermal refining of the surface which is effective as a substrate of a coated sintered alloy part such as a cutting insert of cutting tools or a wear resistant part of wear resistant tools and to a method for making the same.

The so-called coated sintered alloy such as cemented carbides coated with thin layers of highly wear resistant materials such as TiC, TiCN, TiN, $Al_2O_3$, etc., is endowed with both toughness from the cemented carbide substrate and excellent wear resistance from the coated film, and has been provided widely for practical uses.

The above coated layer, while being excellent in wear resistance, is on the other hand extremely brittle, and therefore cracks are liable to be formed in said coated layer during service, and there was a problem that the cracks were expanded even to the substrate to develop a breakage in the cutting edge. As an excellent prior art proposed for solving this problem, there is Japanese Provisional Patent Publication No. 87719/1979 (which corresponds to U.S. Pat. No. 4,277,283), and this has been already practically utilized.

This prior art discloses a cemented carbide comprising hard phase having B-1 type crystal structure of carbonitride (hereinafter called $\beta$ phase), another hard phase of WC, and a binder phase of an iron group metal, in which the $\beta$ phase so migrates from the surface layer of from 5 to 200 microns of the cemented carbide body that the amount of the $\beta$ phase in the surface layer is less than in the inside, or the surface layer is free of the $\beta$ phase. And it is stated that the migration of the $\beta$ phase occurs to the cemented carbide when a green compact comprising the B-1 type carbonitride, WC and an iron group metal is partially denitrified at the surface of the green compact during vacuum sintering. Therefore, the green compact in this prior art indispensably has to contain some nitrogen.

The phenomenon of the migration of $\beta$ phase from the surface layer of the cemented carbide containing nitrogen was studied in detail by Dr. Hisashi Suzuki, professor of University of Tokyo at that time ("Journal of The Japan Society of Powder and Powder Metallurgy", vol. 29, No. 2, pp. 20–23) and it is shown that the migration of $\beta$ phase from the surface of the cemented carbide occurs along with denitrification during vacuum sintering.

As mentioned above, the $\beta$-migrated cemented carbide has been utilized as a substrate of the coated hard alloy part. However, when the $\beta$-migrated cemented carbide according to this prior art was used as a substrate of the coated hard alloy part, it was still found to be insufficient in tool failures such as breakage and wear, as shown below.

FIG. 1 is cited from the drawing described on p. 302 in "Sintered Cemented Carbide and Sintered Hard Material" edited by Dr. Suzuki (Maruzen). As can be seen from the graph in FIG. 1, the migration of $\beta$ phase is surely realized by the prior art. However, to observe the distribution of the binder metal Co, it is known that the relative concentration of the binder phase at the outermost surface is rather the same level as, or even lower than, the average concentration in the inside. Accordingly, as a matter of course, when such $\beta$-migrated cemented carbide with binder-metal-poor outermost surface is used as a substrate for the coated hard alloy part, the effect of inhibiting development of cracks generated in the brittle film to the substrate will be cancelled.

Further, such a coated hard alloy part in which the substrate comprises the $\beta$-migrated cemented carbide is significantly disadvantageous when the coated film was peeled off or the coated film was worn away, namely, when the surface of the substrate had been exposed, because severe cratering occurs on the rake face of the cutting tool for lack of $\beta$ phase in the surface layer of the substrate. It has been well known that the $\beta$ phase is a strong cratering-resistant ingredient in cemented carbide.

Another prior art pertinent to the present invention has been disclosed in U.S. Pat. No. 4,610,931. This prior art presents a cemented carbide with a binder-enriched surface.

According to the specification of the above prior art, the cemented carbide with binder-enriched surface can be formed, preferably, for example, through the following process: milling and blending WC powder, Co powder and TiN powder; then compacting the blended powder into a desired shape; finally sintering in vacuum furnace the compact so as to transform the TiN to its carbide. According to FIGS. 2 and 3 of the patent, the cemented carbide made by this patent has a characteristic in the relative concentrations of binder phase and $\beta$ phase the same in the $\beta$-migrated cemented carbide mentioned above. Therefore, the cemented carbide with binder-enriched surface according to the patent has the same disadvantages described in the case of $\beta$-migrated cemented carbide above.

SUMMARY OF THE INVENTION

An object of the present invention is to provide a substrate having a novel structure useful for coated cemented carbide by overcoming the disadvantages possessed by the prior art as described above.

The present invention provides a surface-refined sintered alloy body comprising a hard phase containing at least one selected from the group consisting of carbides, carbonitrides, carbooxides, carbonitrooxides of the metals of the groups 4a, 5a and 6a of the periodic table and a binding phase containing at least one selected from iron group metals, characterized in that the concentration of the binding phase is highest at the outermost surface and approaches the concentration of the inner portion, the concentration of the binding phase decreasing from the outermost surface to a point at least 5 microns from the surface (See FIG. 7). According to a first embodiment, the concentration of the binding phase smoothly approaches the concentration of the inner portion (See FIG. 8). According to a second embodiment, the binding phase decreases to take a minimum value lower than the concentration in the inner portion, but is then increased smoothly to the concentration in the inner portion (See FIGS. 2 and 9).

DETAILED DESCRIPTION OF THE PREFERRED EMBODIMENTS

Figure 2:
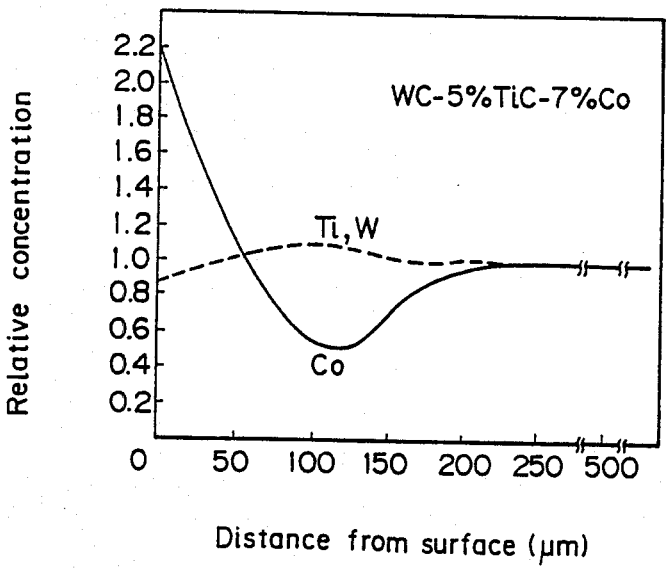
FIG. 2 shows relative concentration distributions of Co, W and Ti according to the present invention.

FIG. 2 shows relative concentration distributions of the respective elements from the surface to the inner portion of the sintered alloy provided as an example by the present invention when the average concentration in the inner portion is made. The surface layer in which the concentration of the binding phase varies is from 10 to 500 microns thick. That is, as is apparent from this figure, the concentration of Co is highest at the outermost surface of the alloy according to the present invention and is greater than the concentration in the inner portion. Subsequently, it decreases to take a minimum value smaller than the concentration in the inner portion and thereafter is increased until becoming finally the concentration of the inner portion.

Also, the present invention provides as the method for producing the above surface-thermally-refined sintered alloy comprising a hard phase containing at least one selected from the group consisting of carbides, carbonitrides, carbooxides, carbonitrooxides of the metals of the groups 4a, 5a and 6a of the periodic table and a binding phase containing at least one selected from iron group metals, characterized in that the concentration of the binding phase in the surface layer (of from 10 microns to 500 microns from the surface of said sintered alloy) is highest at the outermost surface and approaches the concentration of the inner portion, the concentration of the binding phase decreasing from the outermost surface to a point at least 5 microns from the surface, by applying a decarburization treatment at the surface of said sintered alloy at temperatures within the solid-liquid co-existing region of the binding phase after sintering or in the process of sintering. In this method, preferably after sintering of said sintered alloy or in the process of sintering, by applying decarburization treatment at a slow speed at the surface of said sintered alloy at temperatures within the solid-liquid co-existing temperature region of the binding phase, the concentration of the binding phase in the surface layer (of from 10 microns to 500 microns from the surface of the sintered alloy) becomes highest at the outermost surface, and smoothly approaches the concentration in the inner portion while the concentration of binding phase decreases from the outermost surface to a point at least 5 microns from the surface. Also preferably, by applying decarburization treatment at a rapid speed at the surface of the sintered alloy or applying decarburization treatment at the surface of said sintered alloy after performing carburization treatment at the surface of said sintered alloy, the concentration of the binding phase in the surface layer (of from 10 microns to 500 microns from the surface of said sintered alloy) becomes highest at the outermost surface (assuming a value greater than the average concentration in the inner portion) and then takes a minimum value lower than the concentration in the inner portion, the concentration of the binding phase decreasing from the outermost surface to a point at least 5 microns from the surface, and then increasing smoothly to the concentration of the inner portion.

In the present invention, at least one hard coating layer may be formed on the outermost surface of the sintered alloy. As materials for forming the hard coating layer, there may be mentioned, for example, carbides, nitrides, carbooxides or oxynitrides of the metals of the groups 4a, 5a and 6a of the periodic table, mutual solid solutions of these compounds, $Al_2O_3$, AlN, Al(ON), SiC, $Si_3N_4$, diamond or cubic boron nitride. A thickness of the layer may preferably be 0.1 to 20 microns as conventionally used.

The present invention has been accomplished on the basis of a knowledge that only the binding phase can be enriched in the surface layer in a sintered alloy containing indispensably carbon by reheating the sintered alloy at the solid-liquid co-existing temperature of the binding phase in a decarburizing atmosphere to thereby decarburize the surface layer of said sintered alloy. The mechanism in which the binding phase enrichment phenomenon occurs is not necessarily clear, but it may be considered to be based on the principle as described below.

For convenience of explanation, explanation is made by referring to the sectional phase view in 16% Co in the simple W-Co-C ternary diagram shown in FIG. 3.

Figure 3A:
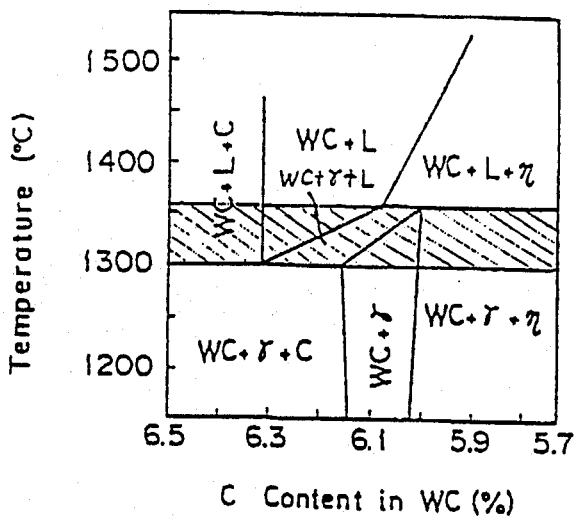
FIG. 3A shows a sectional phase diagram in 16% Co/WC.

The sintered alloy may be prepared according to any known method, and the sintered alloy thus prepared is heated to temperatures within the solid-liquid co-existing temperature region of the binding phase as shown by the cross-hatched portion in FIG. 3A. During heating, by making the atmosphere in the furnace a decarburizing atmosphere with, for example, $CO_2$ gas, etc., decarburization occurs at the surface of said sintered alloy, whereby the carbon concentration at the surface is reduced as shown by the arrowhead b in FIG. 3B to reach the solidus line CD of the binding phase and the liquid phase solidifies, and volume reduction occurs accompanied therewith. As the result, the liquid phase is supplied from the inner portion, and this also reaches near the surface where it is decarburized to reach the solidus line CD, and then solidifies. Similar procedures are repeated until the binding phase is enriched near the surface.

Figure 1:
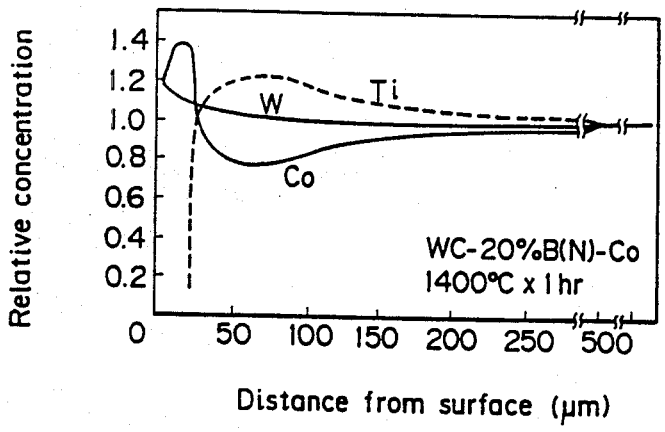
FIG. 1 shows relative concentration distributions of Co, W and Ti according to the prior art, B(N) means WC-TiC-TiN solid solution.

The reason why the concentration of the binding phase becomes rather smaller as shown in FIG. 1 near the surface by $\beta$ removal as disclosed in the above mentioned prior art Japanese Provisional Patent Publication No. 87719/1979 may be considered to be due to evaporation during sintering according to the study by the professor Suzuki et al. ("Journal of the Japan Institute of Metals", vol. 45, p. 98). In the case of the present invention, it is considered that no such evaporation occurs and consequently maximum concentration at the surface can be maintained, because evaporation can be avoided by solidification of the surface binding phase by surface decarburization.

In the present invention, since the liquid phase supplied to the surface can be afforded soonest from the portion relatively nearer to the surface as a matter of course, if the decarburization treatment is rapidly practiced, shortage of the liquid phase will occur near that portion to form a minimum point of the binding phase concentration. On the other hand, if the decarburization treatment is practiced slowly, a product with substantially no such minimum point can be obtained. For example, when an alloy of WC-5% Co is decarburized with the use of an atmosphere gas of $H_2+CO_2$, decarburization under the conditions of a $CO_2$ gas concentration of 10% or higher in the atmosphere gas, an atmosphere gas pressure of 10 torr or higher, a temperature of 1330 ° C. or lower and a treatment time within 3 minutes is rapid decarburization treatment, whereby a minimum value can be made in the relative concentration distribution of the binding phase. On the other hand, decarburization under the conditions of a $CO_2$ gas concentration in the atmosphere gas of 10% or less, an atmosphere gas pressure of 10 Torr or less, and a temperature of 1330° C. or higher and a treatment time of 3 minutes or higher is slow, whereby substantially no minimum value is formed in the relative concentration distribution of the binding phase. Also, generally in a sintered alloy with high Co content or a sintered alloy with high C content, the above enrichment phenomenon of the binding phase near the surface by decarburization treatment occurs rapidly, and therefore the above respective conditions can be controlled suitably depending on the sintered alloy used. If the decarburization operation is performed particularly abruptly in a strong decarburization atmosphere, the binding phase and the hard phase will appear alternately in layers in parallel to the surface in the binding phase enrichment region near the surface.

The surface-thermally-refined sintered alloy with the relative binding phase concentration becoming highest at the outermost surface may be considered to be obtained according to such a mechanism. The surface-thermally-refined sintered alloy thus obtained is recognized to involve the following facts. That is, it is different from that obtained as the result of migration of the $\beta$ phase containing nitrogen to the inner portion. Also, irrespectively of whether the $\beta$ phase contains nitrogen or not, both $\beta$ phase and WC phase exist in the surface layer, and yet the ratio of the amount of the $\beta$ phase relative to the amount of the WC phase is nearly equal to that in the inner portion or the $\beta$ phase is slightly greater in amount.

Also, since the surface-thermally-refined sintered alloy of the present invention is not obtained through $\beta$ removal, it is not required that the B-1 type carbonitride containing nitrogen should be made a hard phase. That is, it is an epoch-making product which is applicable also for the simplest cemented carbide of the WC - Co system, also for a TiC base cermet containing no nitrogen, and also for a cermet containing nitrogen as a matter of course.

Further, when the hard phase in the sintered alloy comprises, for example, WC and B-1 type carbonitride, on the surface layer of the sintered alloy may preferably be formed a $\beta$ removal layer as disclosed in the above-mentioned prior art Japanese Provisional Patent Publication No. 87719/1979 which corresponds to U.S. Pat. No. 4,277,283 or Suzuki et al. ("Journal of the Japan Society of Powder and Powder Metallurgy," vol. 29, No. 2, pp. 20–23 and "Journal of the Japan Institute of Metals," vol. 45, p. 98), more specifically, forming a layer comprising a hard phase of WC and a binding phase thereon, and then the treatment of the surface-refined sintered alloy according to the present invention is effected to make the relative concentration of the binding phase as mentioned above.

As can be seen from the above description, the decarburization operation is not necessarily required to be performed after sintering. That is, during the process of sintering, decarburization may be conducted after the temperature is once lowered below the solid-liquid co-existing temperature of the binding phase by elevating again to the solid-liquid co-existing temperature of the binding phase, or alternatively decarburization may be effected at the solid-liquid co-existing temperature of the binding phase during the process of sintering to give the surface-thermally-refined sintered alloy of the present invention.

Figure 3B:
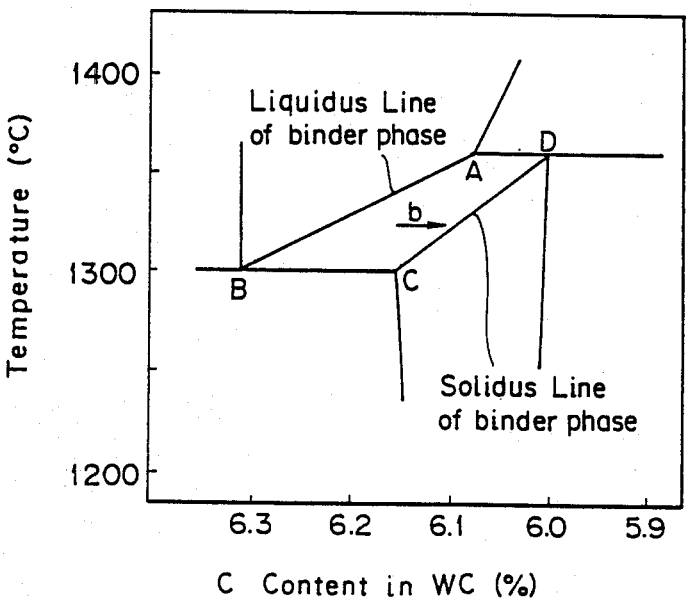
FIG. 3B shows an enlarged view of the solid-liquid coexisting region of the binding phase in FIG. 3A.

On the other hand, by applying carburization at the surface of the sintered alloy at the solid-liquid co-existing temperature of the binding phase, the carbon content at the surface will be increased in the direction opposite to the arrowhead b in FIG. 3B to reach the liquidus line AB of the binding phase, whereby the phenomenon opposite to the above phenomenon will occur. By performing the operation of decarburization as described above after applying such carburization treatment, the valley of the minimum portion of the binding phase concentration can be produced more deeply and stably. Also, by applying the carburization treatment before the above decarburization treatment, the binding phase concentration may sometimes be increased after taking once the minimum value as described above and take again a small maximum value surpassing the concentration in the inner portion and thereafter become the concentration in the inner portion. However, this will pose substantially no problem at all.

As described above, the cemented carbide obtained according to the method of the present invention has a concentration of the binding phase which is substantially the highest at its surface, and therefore the cracks generated in the brittle coated layer can be inhibited in propagation at the surface of substrate, thereby preventing the fracture of the tool.

Also, even if the coated layer is spalled off or worn so that the substrate is exposed, due to appropriate existence of the $\beta$ phase and the WC phase, wear of the tool tip can be suppressed to a minimum.

Further, since it is possible to make a portion with a minimum value of binding phase concentration smaller than the binding phase concentration in the inner portion at an appropriate depth from the surface, not only propagation of the cracks to the inner portion can be inhibited by the maximum portion of the binding phase concentration at the surface, but also the plastic deformation of the tool tip which becomes frequently the problem in high speed heavy cutting can be suppressed at the minimum portion of the binding phase concentration, whereby plastic deformation and the damage generated therefrom can be prevented.

EXAMPLES

Example 1

As the powders for starting materials, the respective powders (particle size 1.5 3 $\mu$m) of commercially available WC, WC-TiC solid solutions (WC/TiC=70/30, weight ratio) and Co were used, and mixed to a composition of 88% WC - 5% TiC - 7% Co (% by weight) followed by wet ball milling with acetone as the solvent for 48 hours. After milling, via drying, the mixture was press molded to the shape of the specimen for transverse rupture test according to JIS, and then sintered in vacuum at 1380 .C for one hour. These were subjected to surface grinding and then divided into the two groups, one of which was subjected to carburization in 20 torr of a gas mixture of 80% $H_2$ - 20% $CH_4$ at 1330° C. for 10 minutes, before decarburization treatment in 10 torr of a gas mixture of 90% $H_2$ - 10% $CO_2$ at 1310° C. for two minutes, followed by furnace cooling in vacuum. For these samples, the concentration distributions of each element of W, Ti and Co on the cross-section perpendicular to the surface were analyzed by EPMA as the function of the distance from the surface. The results obtained are shown in FIG. 2. The concentrations of the respective elements here are shown as normalized with the respective concentrations at the sample center being as 1. From these results, Co content becomes the maximum at the surface of the sample, and reduces continuously toward the inner portion to indicate the minimum value, and thereafter becomes the inner portion value. And, the content of W and Ti indicates the opposite tendencies corresponding to the change in Co content. On the other hand, for untreated samples, the respective element concentrations all indicated constant values over the cross-section of the samples.

Subsequently, TiC was coated to 5 μm thickness according to the chemical vapor deposition method on the samples applied with the above treatment and the untreated samples. And, the transverse rupture strength according to JIS was measured to give the result as an average value of 20 samples, respectively, of a high strength of 194 kg/mm$^2$ for the samples applied with a surface treatment, as contrasted to 132 kg/mm$^2$ for untreated samples.

Example 2

By use of various commercially available powders for starting materials, according to a conventional preparation method, a plural number of green compacts with SNMN 120408 shape with a formulation composition of 88% WC 3% TiC 3% TaC-1% NbC - 5% Co (% by weight) were prepared. And, a part of these were subjected to nitrification treatment in a nitrogen gas of 30 torr at 1200° C. for 30 minutes before sintering, and then sintered in vacuum at 1420° C. for one hour. All of the remaining green compacts were subjected to vacuum sintering at 1420° C. for one hour without passing through the nitrification treatment. And, except for a part of the sintered product, they were subjected to the treatment as shown in Table 1. After the treatment, EPMA analysis of the Co concentration distribution on the cross section perpendicular to the surface of each sample was conducted as the function of the depth from the surface. As the result, with the value at the center of the sample being 100%, the distributions as shown in Table 1 were confirmed.

Figure 4:
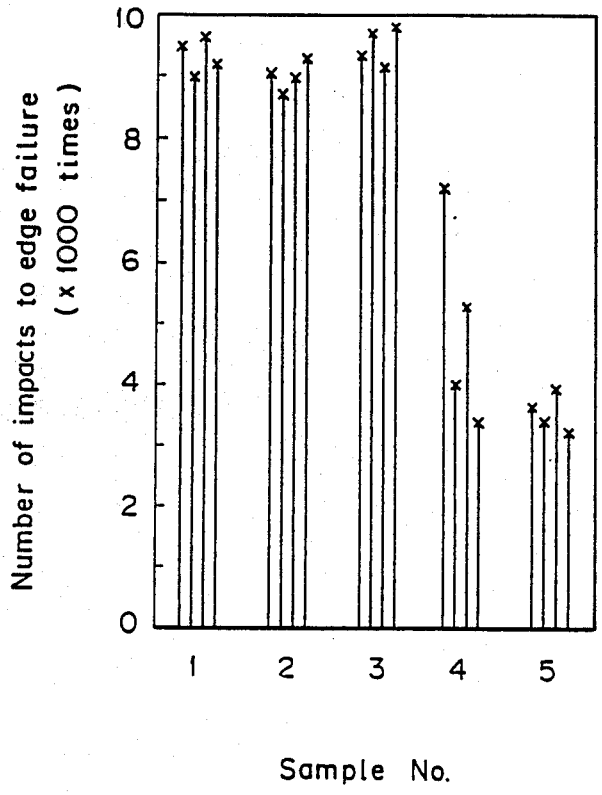
FIG. 4 shows a graph of the impact resistance test results of samples No. 1–No. 5.
Figure 5:
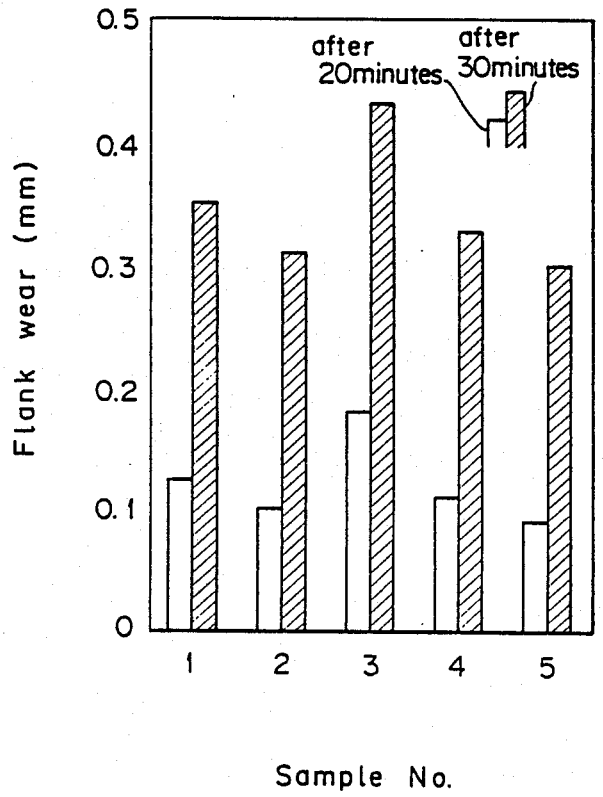
FIG. 5 is a graph of the wear resistance test results of the same samples.

Subsequently, all the samples were successively coated with 1 μm of TiC, 4 μm of TiCN and 1 μm of A1203 according to the chemical vapor deposition method to obtain coated cemented carbide. For these, the impact resistance test and wear resistance test by turning were conducted under the conditions shown below, to obtain the results shown in FIG. 4 and FIG. 5, respectively

| | | |
|---|---|---|
| (1) | Impact resistance test | |
| | Workpiece | S48C ($H_B$ 255), with 4 slots at equal intervals. |
| | Cutting speed | 100 m/min. |
| | Depth of cut | 1.5 mm |
| | Feed | 0.3 mm/rev. |
| | No lubricant | (dry cutting) |
| (2) | Wear resistance test | |
| | Workpiece | S48C ($H_B$ 240) |
| | Cutting speed | 180 m/min. |
| | Depth of cut | 1.5 mm |
| | Feed | 0.24 mm/rev. |
| | No lubricant | (dry cutting) |

TABLE 1

| Sample | Treatment condition | Co amount in the respective depths from surface | | | | |
|---|---|---|---|---|---|---|
| | | Surface | 50 μm | 100 μm | 150 μm | 200 μm |
| Sample ① of this invention | 1330° C. → 1290° C. gradually cooled at 5° C./min. 85% $H_2$—15% $CO_2$, 20 torr | 200% | 120% | 80% | 90% | 100% |
| Sample ② of this invention | 1330° C. × 10 min. 80% $H_2$—20% $CH_4$, 30 torr then 1320° C. × 3 min. 90% $H_2$—10% $CO_2$, 10 torr | 180% | 110% | 70% | 85% | 95% |
| Sample ③ of this invention | 1350° C. × 10 min. 90% $H_2$—10% $CO_2$, 5 torr | 230% | 180% | 140% | 120% | 110% |
| Sample ④ of Comparative | With nitrification treatment and without decarburization treatment | 90% | 140% | 80% | 90% | 95% |
| Sample ⑤ of Comparative | Without nitrification treatment and without decarburization treatment | 100% | 100% | 100% | 100% | 100% |

From the above results, it can be seen that the samples of the present invention have excellent characteristics with greatly improved edge strength without lowering wear resistance, and also with extremely small scatter in edge strength.

Example 3

Figure 6:
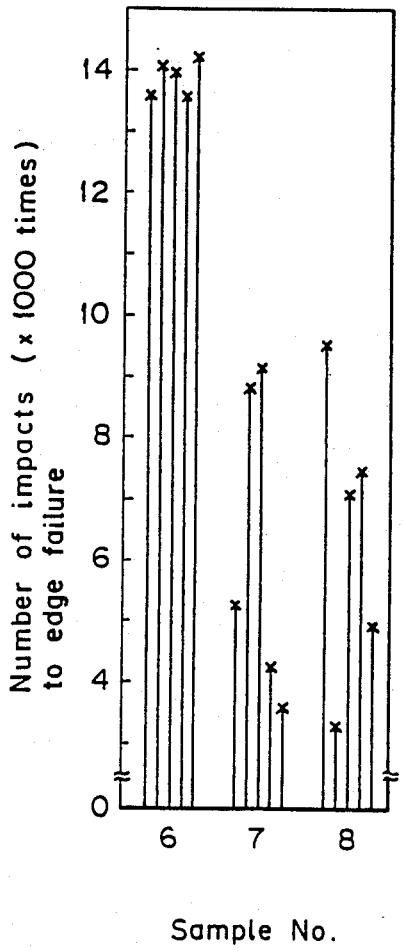
FIG. 6 is a graph of the impact resistance test results of samples No. 6–No. 8.
Figure 7:
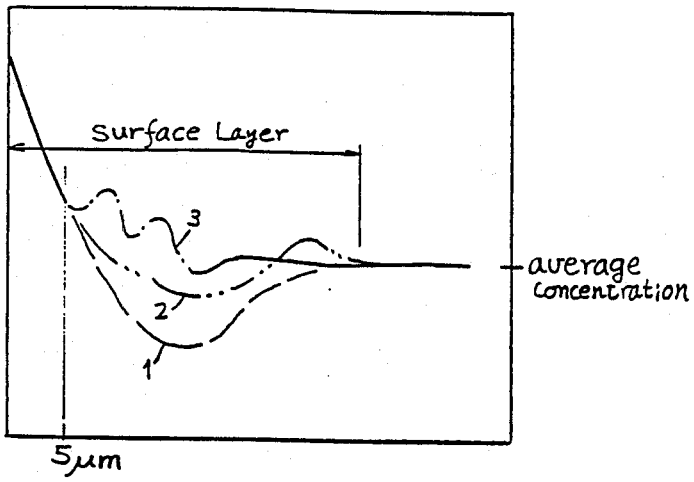
FIG. 7 shows concentration distributions of Co, W and Ti according to the present invention.
Figure 8:
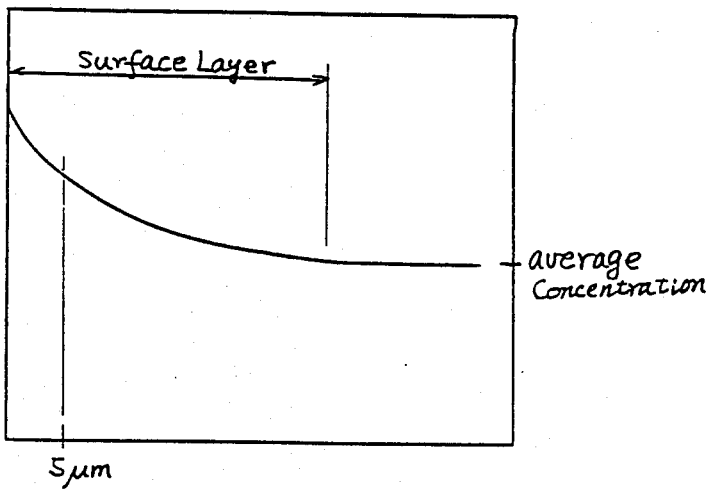
FIG. 8 shows concentration distributions of Co, W and Ti according to a first embodiment of the present invention.
Figure 9:
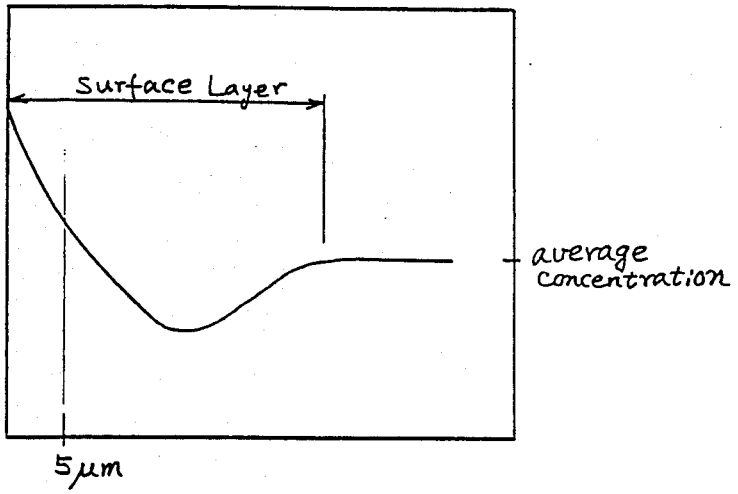
FIG. 9 shows concentration distributions of Co, W and Ti according to a second embodiment of the present invention.

According to the same preparation method as in Example 2, a plural number of samples with TNMN 160408 shape with a formulation composition of 88% WC 2% TiC 4% TaC 5% Co 1% Ni (% by weight) were all prepared by vacum sintering at 1400° C. for one hour. And, these samples were divided into the three groups, then, surface treated under the respective conditions shown in Table 2. The results of EPMA analysis of the distributions of Co+Ni content in the cross-section of the samples as the function of the depth from the surface are shown in the table with the center value of the sample as being 100%. Subsequently, these samples were successively coated with 2 μm TiC, 2 μm TiCN and 2 μm TiN according to the chemical vapor deposition method. And the impact resistance test was conducted under the same conditions as Example 2 to obtain the results shown in FIG. 6. From these results, it can be seen that the distribution of the binding phase at the surface has great effect on the scatter in impact resistance and the impact resistance can be extremely stabilized when the amount of binding phase has a maximum at the surface.

TABLE 2

| Sample | Treatment condition | Co amount in the respective depths from surface | | | | |
|---|---|---|---|---|---|---|
| | | Surface | 50 μm | 100 μm | 150 μm | 200 μm |
| Sample ⑥ of this invention | 1340° C. × 10 min. 90% CO—10% $CH_4$, 20 torr 1330° C. × 1 min. 70% $H_2$—30% $CO_2$, 100 torr | 380% | 210% | 110% | 90% | 95% |
| Sample ⑦ of comparative | 1340° C. × 10 min. 90% CO—10% $CH_4$, 20 torr 1330° C. × 1 min. 70% $H_2$—30% $CO_2$, 100 torr 1320° C. × 1 min. 80% $H_2$—20% $CH_4$, 10 torr | 150% | 180% | 100% | 90% | 95% |
| Sample ⑧ of comparative | 1330° C. × 2 min. 80% $H_2$—20% $CO_2$, 80 torr 1330° C. × 2 min. 75% $H_2$—25% $CH_4$, 10 torr | 210% | 250% | 130% | 110% | 105% |

What is claimed is:

1. A surface-refined sintered alloy body comprising a surface and an inner portion, said body comprising a hard phase containing at least one selected from the group consisting of carbides, carbonitrides, carbooxides, carbonitrooxides of the metals of the groups 4a, 5a and 6a of the periodic table and a binding phase containing at least one selected from iron group metals, characterized in that the concentration of the binding phase is highest at the outermost surface of the body and approaches the concentration of the inner portion, the concentration of said binding phase decreasing from the surface to a point at least 5 microns from the surface.

2. The surface-refined sintered alloy body according to claim 1, wherein the concentration of the binding phase smoothly approaches the concentration of the inner portion.

3. The surface-refined sintered alloy body according to claim 1, wherein the concentration of the binding phase takes a minimum value lower than the concentration of the inner portion and then is increased smoothly to the concentration of the inner portion.

4. A method for making a surface-refined sintered alloy body comprising a surface and an inner portion, said body comprising a hard phase containing at least one selected from the group consisting of carbides, carbonitrides, carbooxides, carbonitrooxides of the metals of the groups 4a, 5a and 6a of the periodic table and a binding phase containing at least one selected from iron group metals, characterized in that the concentration of the binding phase is highest at the outermost surface of the body and approaches the concentration of the inner portion, the concentration of said binding phase decreasing from the surface to a point at least 5 μm from the surface, aid method comprising applying decarburization treatment at the surface of said sintered alloy at temperatures within the solid-liquid co-existing region of the binding phase after sintering or in the process of sintering.

5. A method according to claim 4, wherein the decarburization treatment is applied at a slow speed.

6. A method according to claim 4, wherein the decarburization treatment is applied at a rapid speed.

7. A method according to claim 4, wherein a carburizing treatment is performed before application of the decarburization treatment.

8. A surface-refined sintered alloy body according to claim 1, wherein the concentration of said binding phase varies within a surface layer of from 10 to 500 microns.

9. A surface-refined sintered alloy body according to claim 1, wherein said sintered body further comprises a hard coating layer on the outermost surface of the body.

10. A surface-refined sintered alloy body according to claim 2, wherein said sintered body further comprises a hard coating layer on the outermost surface of the body.

11. A surface-refined sintered alloy body according to claim 3, wherein said sintered body further comprises a hard coating layer on the outermost surface of the body.

12. A surface-refined sintered alloy body according to claim 8, wherein said sintered body further comprises a hard coating layer on the outermost surface of the body.

* * * * *